US010280020B2

(12) United States Patent
Yoshida

(10) Patent No.: US 10,280,020 B2
(45) Date of Patent: May 7, 2019

(54) SHEET CONVEYANCE APPARATUS AND IMAGE FORMING APPARATUS

(71) Applicant: CANON KABUSHIKI KAISHA, Tokyo (JP)

(72) Inventor: Atsushi Yoshida, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 124 days.

(21) Appl. No.: 15/455,377

(22) Filed: Mar. 10, 2017

(65) Prior Publication Data

US 2017/0283198 A1 Oct. 5, 2017

(30) Foreign Application Priority Data

Mar. 30, 2016 (JP) ..... 2016-068676

(51) Int. Cl.
*B65H 5/00* (2006.01)
*B65H 5/36* (2006.01)
(Continued)

(52) U.S. Cl.
CPC ..... *B65H 5/224* (2013.01); *B65H 5/062* (2013.01); *B65H 29/242* (2013.01); *G03G 15/2028* (2013.01); *G03G 15/657* (2013.01); *G03G 15/6529* (2013.01); *B65H 2403/42* (2013.01); *B65H 2403/512* (2013.01); *B65H 2403/72* (2013.01); *B65H 2404/25* (2013.01); *B65H 2404/2693* (2013.01); *B65H 2406/32* (2013.01);
(Continued)

(58) Field of Classification Search
CPC .... G03G 15/00; G03G 15/20; G03G 15/2028; G03G 15/6529; G03G 15/657; G03G 21/00; G03G 21/20; G03G 21/206; B65H 5/00; B65H 5/02; B65H 5/062; B65H 5/224; B65H 5/36; B65H 29/00; B65H 29/242; B65H 29/52; B65H 2403/42; B65H 2403/412; B65H 2403/72; B65H 2404/25; B65H 2404/2693; B65H 2406/32; B65H 2511/20; B65H 2513/412; B65H 2515/81; B65H 2801/06; B65H 2403/512
See application file for complete search history.

(56) References Cited

U.S. PATENT DOCUMENTS 4,745,435 A * 5/1988 Sakata ..... G03G 15/6529 399/322
5,018,716 A 5/1991 Yoshida et al.
(Continued)

FOREIGN PATENT DOCUMENTS

JP 2013-088653 A 5/2013

*Primary Examiner* — Nguyen Q. Ha
(74) *Attorney, Agent, or Firm* — Venable LLP

(57) ABSTRACT

A sheet conveyance apparatus includes a rotary drive member configured to rotate by receiving transmission of driving force from a driving source, a driven rotary member arranged with a predetermined distance in a sheet conveyance direction from the rotary drive member, an endless belt member supported on the rotary drive member and the driven rotary member, and configured to be rotated by a rotation of the rotary drive member, and a guide member configured to guide a sheet conveyed by the belt member. The guide member is mounted to a shaft configured to support the rotary drive member, and the rotary drive member is supported on the shaft in a rotatable manner with respect to the shaft.

13 Claims, 15 Drawing Sheets

(51) Int. Cl.

| | |
|---|---|
| ***B65H 29/00*** | (2006.01) |
| ***B65H 29/52*** | (2006.01) |
| ***G03G 15/00*** | (2006.01) |
| ***G03G 21/00*** | (2006.01) |
| ***B65H 5/22*** | (2006.01) |
| ***B65H 5/06*** | (2006.01) |
| ***G03G 15/20*** | (2006.01) |
| ***B65H 29/24*** | (2006.01) |
| *G03G 21/20* | (2006.01) |

(52) U.S. Cl.
CPC .... *B65H 2511/20* (2013.01); *B65H 2513/412* (2013.01); *B65H 2515/81* (2013.01); *B65H 2801/06* (2013.01); *G03G 21/206* (2013.01)

(56) References Cited

U.S. PATENT DOCUMENTS

| | | | | |
|---|---|---|---|---|
| 5,105,225 | A | 4/1992 | Honjo et al. | |
| 5,351,112 | A | 9/1994 | Naito et al. | |
| 5,579,083 | A | 11/1996 | Naito et al. | |
| 5,671,917 | A | 9/1997 | Choho et al. | |
| 5,819,151 | A | 10/1998 | Naito et al. | |
| 8,942,605 | B2 | 1/2015 | Nakano | |
| 2009/0212484 | A1* | 8/2009 | Kawaguchi ..... | B65H 29/242 271/195 |
| 2013/0101322 | A1 | 4/2013 | Nakano | |
| 2017/0075285 | A1 | 3/2017 | Yoshida et al. | |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus configured to convey sheets, and an image forming apparatus.

Description of the Related Art

Generally, in an image forming apparatus such as a copying machine or a printer, a configuration in which sheets are conveyed via roller pairs is widely known. Further, a configuration in which sheets are sucked onto a conveyor belt and conveyed in an area between a transfer portion and a fixing unit where images are conveyed in a non-fixed state is known.

Heretofore, in such a sheet conveyance apparatus, a pre-fixing conveyance apparatus is devised in which a sheet is guided and conveyed by a conveyor belt and a guide member, and the guide member is retained on a drive pulley shaft of the conveyor belt, as disclosed in Japanese Unexamined Patent Application Publication No. 2013-88653.

In a state where the guide member is retained on the drive pulley shaft as in the pre-fixing conveyance apparatus disclosed in the above Japanese Unexamined Patent Application Publication No. 2013-88653, the positional relationship between the conveyor belt and the guide member can be preferably retained. However, in this disclosure, the drive pulley shaft is driven to rotate while conveying the sheet, and in a case where the guide member is warped, for example, the frictional load between the drive pulley shaft and the guide member becomes excessive. In a state where the frictional load is increased, required force for conveying the sheet is undesirably increased, and the power used by the driving source and the rising of temperature of the driving source becomes too high.

SUMMARY OF THE INVENTION

The sheet conveyance apparatus according to the present invention includes a rotary drive member configured to rotate by receiving transmission of driving force from a driving source, a driven rotary member arranged with a predetermined distance in a sheet conveyance direction from the rotary drive member, an endless belt member supported on the rotary drive member and the driven rotary member, and configured to be rotated by a rotation of the rotary drive member, a guide member configured to guide a sheet conveyed by the belt member, and a shaft configured to support the rotary drive member, the guide member being mounted to the shaft. The rotary drive member is supported on the shaft in a rotatable manner with respect to the shaft.

Further features of the present invention will become apparent from the following description of exemplary embodiments with reference to the attached drawings.

DESCRIPTION OF THE EMBODIMENTS

First Embodiment

Figure 1:
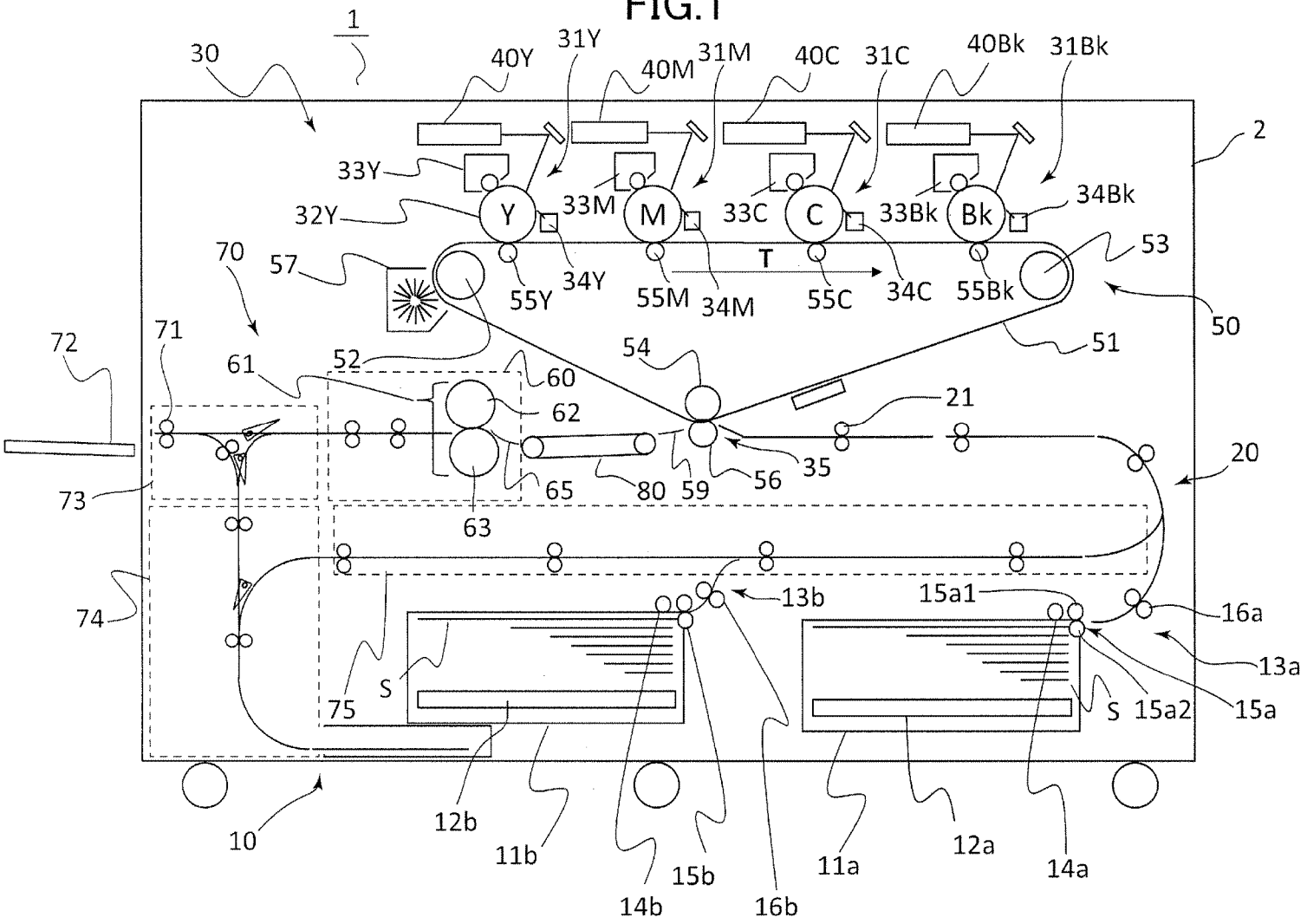
FIG. 1 is a schematic configuration diagram of an image forming apparatus according to a first embodiment.

Hereafter, a printer 1 serving as an image forming apparatus according to an embodiment of the present invention will be described. As illustrated in FIG. 1, the printer 1 includes a sheet feeding unit 10 configured to feed sheets, a sheet conveyance unit 20 configured to convey the sheets fed from the sheet feeding unit 10, and an image forming unit 30 configured to form images on the sheets conveyed from the sheet conveyance unit 20. The sheet feeding unit 10 includes a plurality of (in the case of the present embodiment, two) sheet cassettes 11*a* and 11*b* provided at a lower portion of an apparatus body 2 of the printer 1, and the sheet cassettes 11*a* and 11*b* storing the sheets respectively constitute a sheet supporting portion configured to support, i.e., stack, sheets. Further, intermediate plates 12*a* and 12*b* serving as sheet support portions for supporting, i.e., stacking, sheets are provided in the sheet cassettes 11*a* and 11*b*. The intermediate plates 12*a* and 12*b* are elevated to retain a sheet height of an uppermost sheet at a predetermined sheet feeding position.

The sheet feeding unit 10 also includes, in the respective sheet cassettes, separation feeding units 13*a* and 13*b* configured to separate and feed the stacked sheets one by one. Since the separation feeding units 13*a* and 13*b* have approximately the same configurations, in the following description, only the configuration of the separation feeding unit 13*a* will be described, and the description of the configuration of the separation feeding unit 13*b* will be omitted. The separation feeding unit 13*a* includes a pickup roller 14*a* in contact with and feeding an uppermost sheet of the sheets supported on the sheet cassette 11*a*, a separation roller pair 15*a* disposed downstream in a sheet conveyance direction of the pickup roller 14*a*, and a drawing roller pair 16*a*. The separation roller pair 15*a* constitutes a separation nip by a conveyance roller 15*a*1 that rotates in a same direction as the pickup roller 14*a* and a separation roller 15*a*2 that either rotates in an opposite direction as the sheet conveyance direction or stops in a state where multiple sheets are fed. The separation nip is configured to separate a lower sheet fed together with the uppermost sheet from the uppermost sheet. The drawing roller pair 16*a* is disposed downstream in the sheet conveyance direction of the separation roller pair 15*a*, where the sheet conveyed from the separation roller pair 15*a* is drawn out and conveyed toward a registration roller pair 21 described later.

The sheet conveyance unit 20 has a plurality of roller pairs disposed downstream in the sheet conveyance direction of the drawing roller pairs 16*a* and 16*b*. Among the plurality of roller pairs, the roller pair disposed immediately upstream of a secondary transfer portion 35 transferring images on sheets serves as the above-described registration roller pair 21. The registration roller pair 21 is configured to convey the sheet to the secondary transfer portion 35 in synchronization with an image forming timing of the image forming unit 30, and to perform skew feed correction of sheets.

The image forming unit 30 includes yellow, magenta, cyan, and black process cartridges 31Y, 31M, 31C and 31Bk, exposing units 40Y, 40M, 40C and 40Bk provided to the respective process cartridges, and an intermediate transfer unit 50. The process cartridges 31Y, 31M, 31C and 31Bk are arranged in the order of yellow, magenta, cyan and black along an intermediate transfer belt 51. The configurations of the respective process cartridges are basically the same, except for the difference in the color of the toner being stored, so only the configuration of the yellow process cartridge 31Y will be described here.

The process cartridge 31Y is composed of a photosensitive drum 32Y, and a charging apparatus (not shown), a developing apparatus 33Y and a drum cleaning apparatus 34Y are arranged in a periphery of the photosensitive drum 32Y. A surface of the photosensitive drum 32Y is charged to a uniform potential, and laser beams corresponding to image information signals are irradiated from an exposing unit 40Y to the uniformly charged surface, thereby forming an electrostatic latent image on the surface of the drum. The electrostatic latent image formed on the surface of the photosensitive drum 32Y is developed by the developing apparatus 33Y, and a toner image is formed.

The intermediate transfer unit 50 includes an intermediate transfer belt 51, a driving roller 52, a tension roller 53, a secondary transfer inner roller 54, and primary transfer rollers 55Y, 55M, 55C and 55Bk, wherein the intermediate transfer belt 51 is wound around and stretched across these rollers. The primary transfer rollers are arranged to face the above-mentioned yellow, magenta, cyan and black photosensitive drums 32Y, 32M, 32C and 32Bk with the intermediate transfer belt 51 intervened, and the primary transfer rollers constitute primary transfer portions with these photosensitive drums. Therefore, the toner images of respective colors formed on the respective photosensitive drums are transferred in a superposed manner at the primary transfer portion, such that a full-color toner image is formed on the intermediate transfer belt 51. In the present embodiment, the intermediate transfer belt 51 is driven in the direction of an arrow T in FIG. 1 by the driving roller 52, and color toner images are transferred onto the intermediate transfer belt 51 in the named order of yellow, magenta, cyan and black.

The secondary transfer inner roller 54 is arranged downstream of the primary transfer portion in a direction of rotation of the intermediate transfer belt 51, i.e., direction of arrow T, and the secondary transfer inner roller 54 constitutes the secondary transfer portion 35 together with a secondary transfer outer roller 56 arranged to face the inner roller 54 with the intermediate transfer belt 51 intervened. In a state where a sheet is conveyed to the secondary transfer portion 35 at a matched timing with the full color toner image formed on the intermediate transfer belt 51, a transfer bias is applied to the secondary transfer outer roller 56, and the full color toner image is transferred to the sheet. Residual toner remaining on the intermediate transfer belt is cleaned by a belt cleaning device 57.

A fixing unit 60 configured to fix to the sheet a non-fixed toner image transferred to the sheet is disposed downstream of the secondary transfer portion 35. The fixing unit 60 is arranged to form a heating nip by a heating roller 62 incorporating a halogen heater and a counter roller 63 opposed to the heating roller 62, and the non-fixed toner image is heated and fixed to the sheet at the heating nip.

The sheet on which the toner image is fixed via the fixing unit, serving as a fixing portion, 60 is conveyed via a sheet discharge portion 70 and discharged via a sheet discharge roller pair 71 onto a discharge tray 72. In a state where duplex printing is performed, the sheet is conveyed via a branched conveyance unit 73 disposed between the fixing unit 60 and the sheet discharge roller pair 71 to a reverse conveyance unit 74. The sheet is conveyed via the reverse conveyance unit 74 to the reverse conveyance path 75, and conveyed again to the secondary transfer portion 35.

Schematic Configuration of Pre-Fixing Conveyance Apparatus

Now, we will describe a pre-fixing conveyance apparatus 80 arranged downstream of the image forming unit 30 and upstream of the fixing unit 60 in the sheet conveyance direction, configured to convey the sheet on which a non-fixed image has been transferred at the secondary transfer portion 35 to the fixing unit 60. As illustrated in FIG. 1, a transfer exit guide 59, a pre-fixing conveyance apparatus 80 and a fixing entrance guide 65 are provided between the secondary transfer portion 35 and the fixing unit 60. The sheet conveyed from the secondary transfer portion 35 is conveyed via the transfer exit guide 59 to the pre-fixing conveyance apparatus 80 and conveyed from the pre-fixing conveyance apparatus 80 via the fixing entrance guide 65 to the fixing unit 60.

Figure 2:
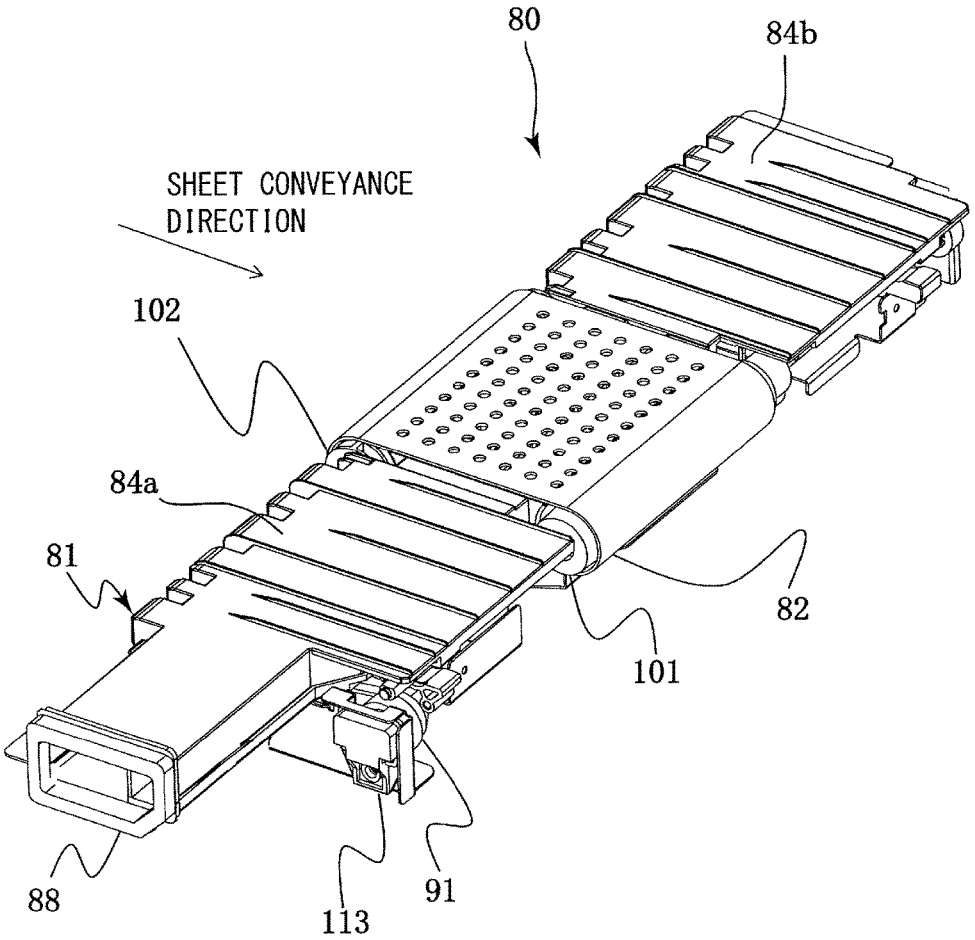
FIG. 2 is a perspective view of a pre-fixing conveyance apparatus according to the first embodiment.

As illustrated in FIG. 2, the pre-fixing conveyance apparatus 80 comprises a guide member 81, and an endless conveyor belt, serving as a belt member, 82 wound around a center portion of the guide member 81. The conveyor belt 82 is a suction belt provided with a plurality of holes. The guide member 81 has an opening portion 83 formed on an inner side of the conveyor belt 82 (refer to FIG. 4), and air is sucked through the opening portion 83 to thereby enable the conveyor belt 82 to suck the sheet while conveying the sheet.

Figure 3:
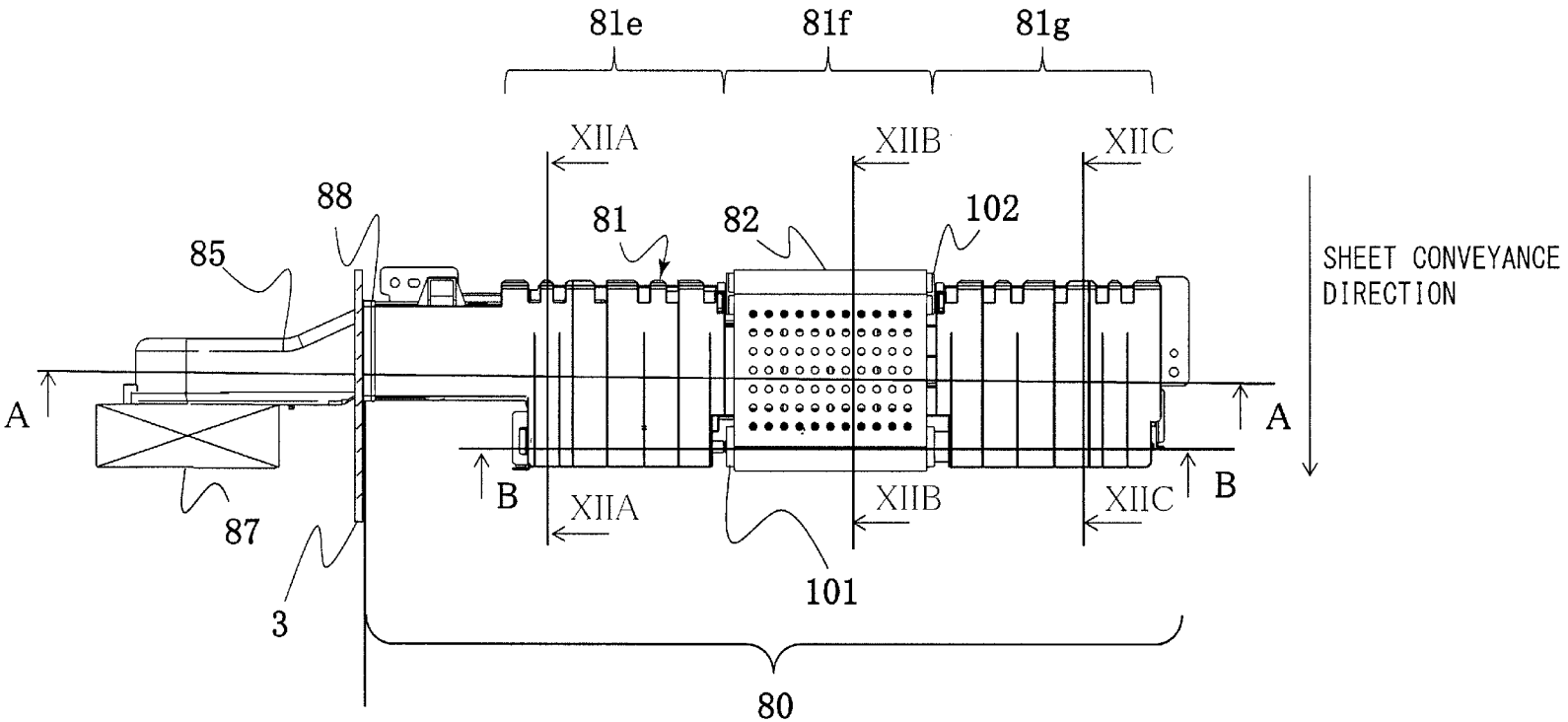
FIG. 3 is a planar view of the pre-fixing conveyance apparatus according to the first embodiment.
Figure 4:
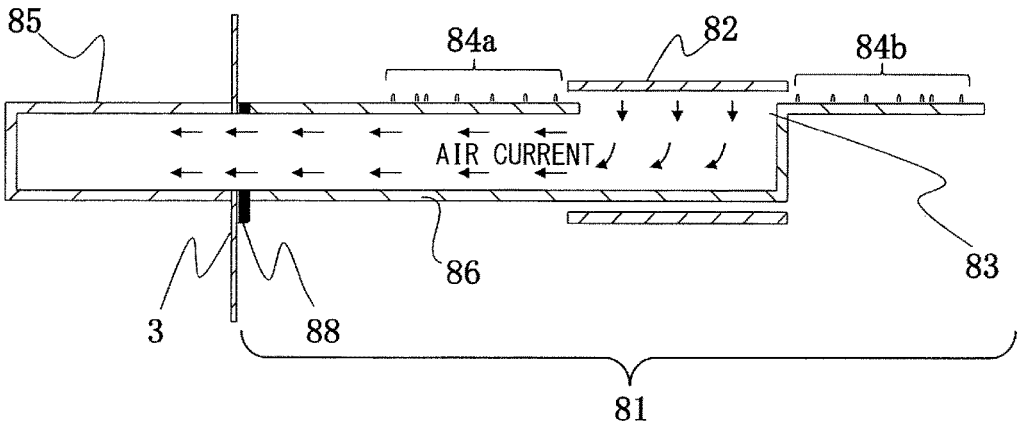
FIG. 4 is a schematic cross-sectional view of the pre-fixing apparatus according to the first embodiment.

Specifically, as illustrated in FIGS. 3 and 4, the guide member 81 has a hollow suction duct portion 86 connected to a fixed duct 85 supported by a body side panel 3 serving as a frame of the apparatus body 2. The suction duct portion 86 is extended and opened to an inner side of the conveyor belt 82 in a width direction orthogonal to the sheet conveyance direction, and a suction fan 87 is attached to the fixed duct 85. Therefore, when air is sucked through the suction fan 87, air is sucked via the fixed duct 85, the hole formed on the body side panel 3 and the suction duct portion 86 through the opening portion 83. A joint portion between the suction duct portion 86 and the hole provided on the body side panel 3 is sealed by a sponge-like seal member 88.

Figure 5A:
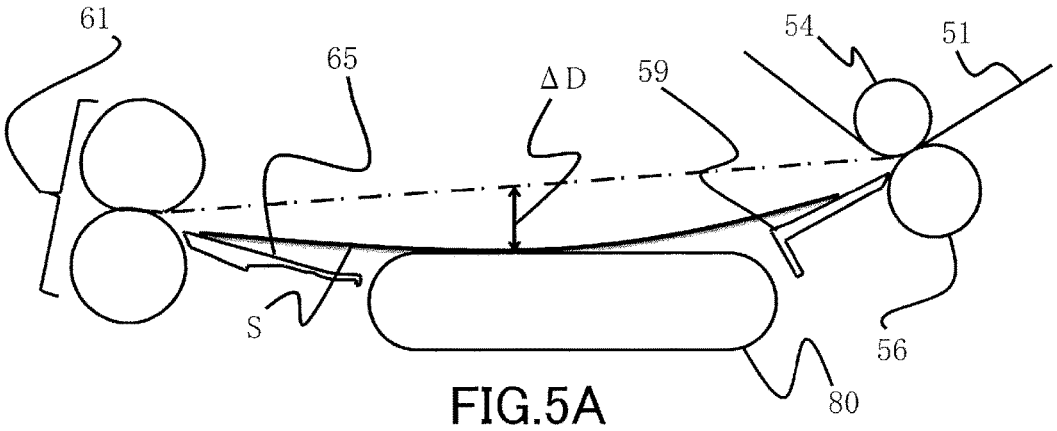
FIG. 5A is a schematic diagram illustrating a configuration of a portion between a transfer portion and a fixing unit during normal state.
Figure 5B:
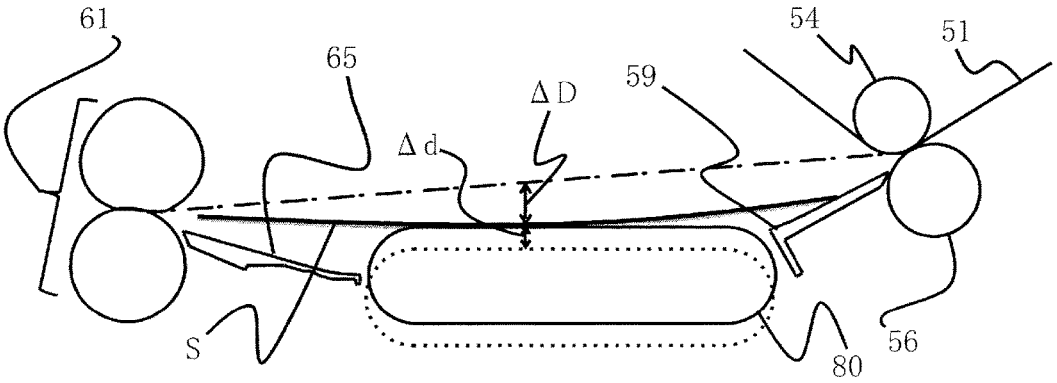
FIG. 5B is a schematic diagram illustrating the configuration of a portion between the transfer portion and the fixing unit in a state where a thick paper is conveyed.

Further, as illustrated in FIGS. 5A and 5B, the pre-fixing conveyance apparatus 80 is configured to elevate the conveyor belt 82 and the guide member, i.e., conveyance guide, 81 by an elevating mechanism 90 (refer to FIG. 11) described in detail later. In other words, the pre-fixing conveyance apparatus 80 forms a sheet conveyance surface configured to support and convey sheets by the conveyor belt 82 and the sheet support portions 84*a* and 84*b* (refer to FIG. 2) of the guide member 81 disposed on both sides in the width direction of the conveyor belt 82. In a normal state, as illustrated in FIG. 5A, the sheet conveyance surface is configured to be positioned lower by ΔD with respect to a line L connecting the secondary transfer portion 35 of a secondary transfer roller pair 54 and 56 and a heating nip portion of a fixing roller pair 61. Thereby, the sheet S is curved, such that the sheet is prevented from being pulled by the secondary transfer portion 35 and the heating nip portion of the fixing roller pair 61. The sheet is guided via the guide member 81 and conveyed by the pre-fixing conveyance apparatus 80 having a weak retaining force. In the present embodiment, the conveyor belt 82 is provided in a narrower range than an image forming area, and the sheet support portions 84*a* and 84*b* of the guide member 81 support the area exceeding the supporting area of the conveyor belt 82.

Further, in a state where a sheet S having a high stiffness, such as thick paper, is conveyed, as illustrated in FIG. 5B, a portion of the pre-fixing conveyance apparatus 80 is elevated for Δd by the elevating mechanism 90. Thereby, the distance ΔD between the sheet conveyance surface and the line L connecting the secondary transfer portion 35 and the heating nip portion of the fixing roller pair 61 is shortened. Thus, it becomes possible to prevent the pre-fixing conveyance apparatus 80 from not being able to suck the sheet due to the high stiffness of the sheet, and the sheet can be conveyed stably.

Drive Configuration of Pre-Fixing Conveyance Apparatus

Figure 6:
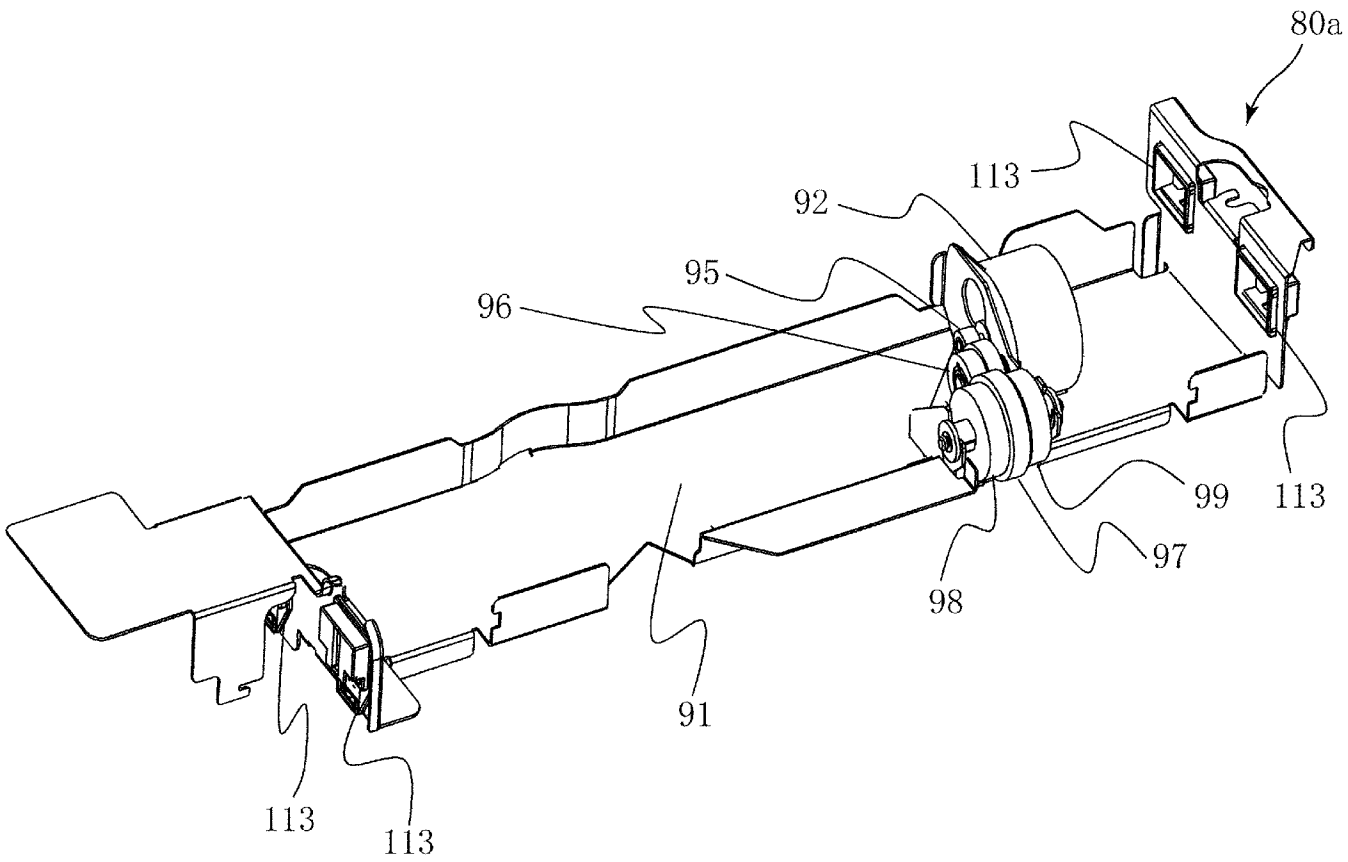
FIG. 6 is a perspective view of a fixed portion according to the first embodiment.
Figure 8:
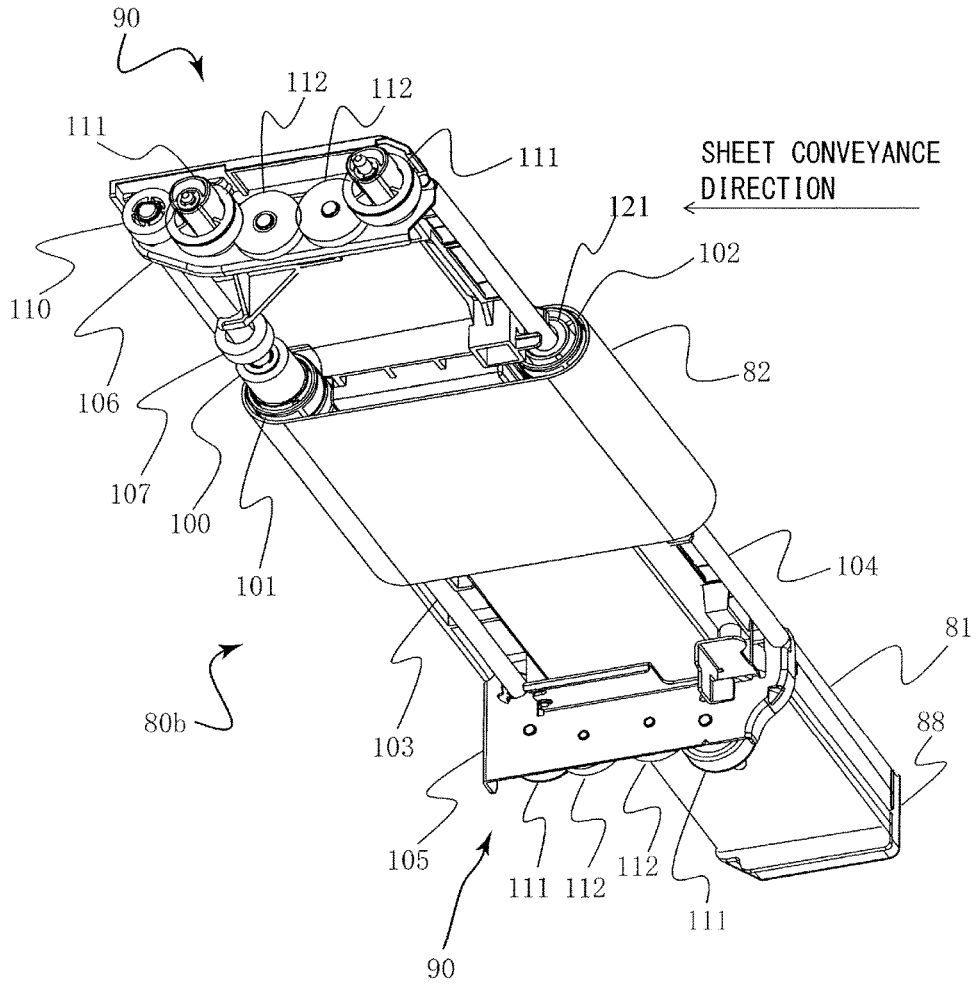
FIG. 8 is a perspective view of the elevating portion viewed from an opposite direction as FIG. 7.
Figure 9:
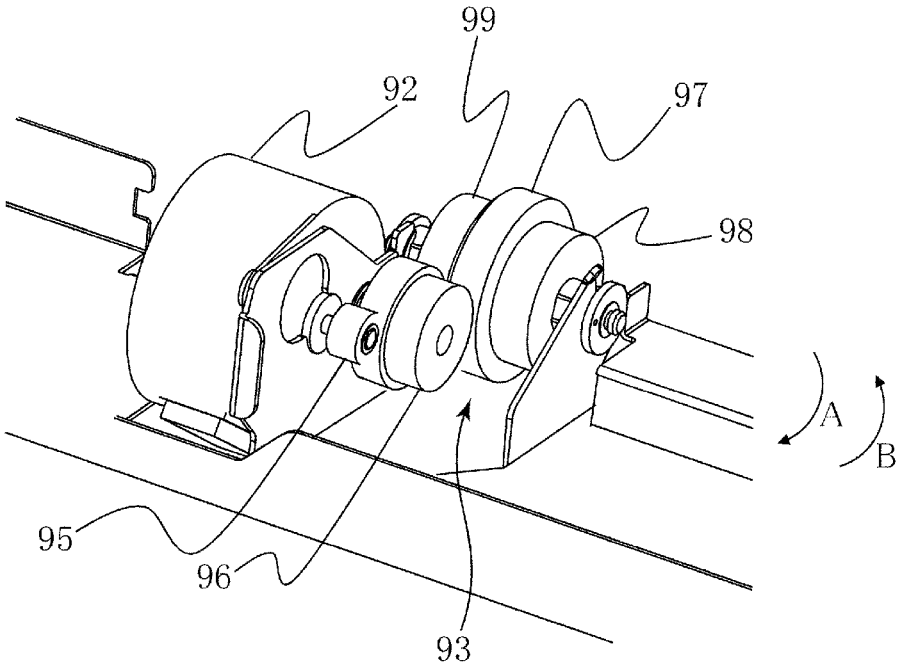
FIG. 9 is a perspective view illustrating a configuration of a portion around a driving source according to the first embodiment.

Next, we will describe a drive configuration of the pre-fixing conveyance apparatus 80. The elevating mechanism 90 is configured to elevate an elevating portion 80*b* illustrated in FIGS. 7 and 8 with respect to a fixed portion 80*a* illustrated in FIG. 6. Specifically, the fixed portion 80*a* is composed of a frame 91, a motor, serving as a driving source, 92 disposed on the frame 91, and a drive train 93 configured to transmit a drive from the motor 92. As illustrated in FIG. 9, the motor 92 is equipped with a pinion gear 95, and the motor 92 is configured to be rotatable in both directions. Further, the drive train 93 is configured of the pinion gear 95, a step gear 96 engaged with the pinion gear 95, a fixed idler gear 97 to which the driving force from the step gear 96 is transmitted, a conveyance one way gear 98 and an elevating one way gear 99.

The conveyance one way gear 98 and the elevating one way gear 99 are respectively engaged with a conveyance input gear 100 and an elevating input gear 107 disposed on the elevating portion 80*b* described later via a swing idler gear not shown, and are equipped with one way clutches whose rotation transmitting directions are opposite. That is, in a state where the motor 92 rotates so that the fixed idler gear 97 rotates in direction A of FIG. 9, the conveyance one way gear 98 rotates, and in a state where the motor 92 rotates so that the fixed idler gear rotates in direction B, the elevating one way gear 99 rotates. In a state where the conveyance one way gear 98 rotates, power is transmitted to a transmission system of the conveyor belt 82, and in a state where the elevating one way gear 99 rotates, power is transmitted to a transmission system of the elevating mechanism 90. In other words, the elevating one way gear 99 serves as a first engagement portion that engages with the elevating input gear 107, serving as an elevation transmission portion, described later, that is driven to rotate in a state where the driving source is driven to rotate in a first direction, and that rotates a drive pulley shaft 103, serving as a rotary drive member shaft, through the elevating input gear 107. Further, the conveyance one way gear 98 serves as a second engagement portion that engages with the conveyance input gear, serving as a transmission portion, 100, that is driven to rotate in a state where the driving source is driven to rotate in a second direction opposite to the first direction, and that rotates a drive pulley, serving as a rotary drive member, through the conveyance input gear 100.

Figure 7:
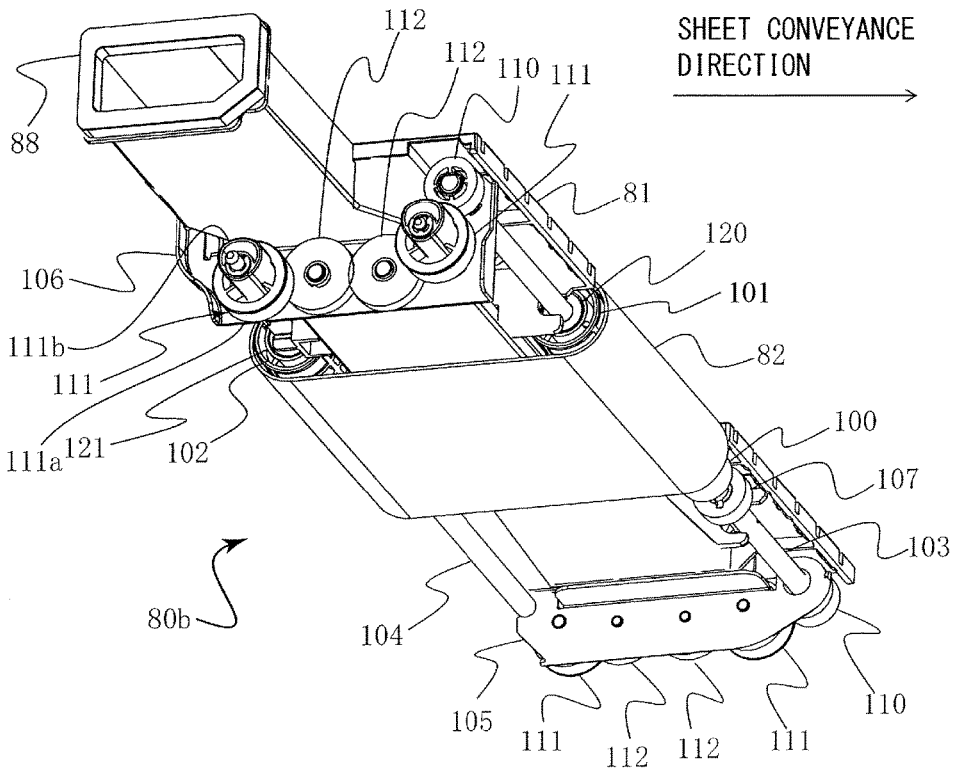
FIG. 7 is a perspective view of an elevating portion according to the first embodiment.

Next, a transmission mechanism provided on the elevating portion side will be described with reference to FIGS. 7, 8, 10 and 11. As illustrated in FIGS. 7 and 8, the conveyor belt 82 is wound around a drive pulley, serving as a rotary drive member, 101 that is driven to rotate by the driving force transmitted from the motor 92, and a driven pulley, serving as a driven rotary member, 102 provided with a predetermined distance in the sheet conveyance direction from the drive pulley 101. The drive pulley 101 and the driven pulley 102 are supported on a drive pulley shaft 103 and a driven pulley shaft 104, and the drive pulley shaft 103 and the driven pulley shaft 104 are respectively supported by a front side panel 105 and a rear side panel 106 disposed on left and right sides thereof. Specifically, the drive pulley shaft 103 is rotatably supported by the front side panel 105 and the rear side panel 106, and the driven pulley shaft, serving as a driven rotary member shaft, 104 is fixed to and supported by the front side panel 105 and the rear side panel 106. The driven pulley 102 is rotatably supported via a bearing 121 on the driven pulley shaft 104, such that the driven pulley can be rotated independently with respect to the driven pulley shaft. Further, the front side panel 105 and the rear side panel 106 are respectively fixed to the above-described sheet support portions 84*a* and 84*b* by screws.

Further, the conveyance input gear 100 and the elevating input gear 107 engaged with the conveyance one way gear 98 and the elevating one way gear 99 are supported on the drive pulley shaft 103, and the elevating input gear 107 is fixed to the drive pulley shaft 103 to rotate together with the drive pulley shaft 103. Further, elevating output gears 110 are provided on both sides of the drive pulley shaft 103, and in a state where the elevating output gears 110 are rotated, cam gears 111 disposed on the front side panel 105 and the rear side panel 106 are configured to be rotated. Two cam gears 111 are respectively provided on the front side panel 105 and the rear side panel 106, and the two cam gears 111 are driven in synchronization via idler gears 112. A gear portion 111*a* and a cam portion 111*b* arranged eccentrically with respect to the gear portion 111*a* are provided on the cam gears 111. Therefore, the position of the elevating portion 80*b* can be changed with respect to the fixed portion 80*a* by the cam portion 111*b* rotating on cam holders 113 disposed on the frame 91 of the fixed portion 80*a*. That is, the elevating mechanism 90 is composed of the cam gears 111, the idler gears 112 and the cam holders 113. Even in a state where the position of the elevating portion 80*b* is changed, the swing idler swings in accordance with the change in the elevated position, such that the conveyance one way gear 98 and the elevating one way gear 99 can respectively transmit force to the conveyance input gear 100 and the elevating input gear 107. Further, even in a state where the position of the elevating portion 80*b* is changed, the sponge-like seal member 88 maintains contact with the body side panel 3 and the leakage of air is prevented, as illustrated in FIG. 4.

Figure 11:
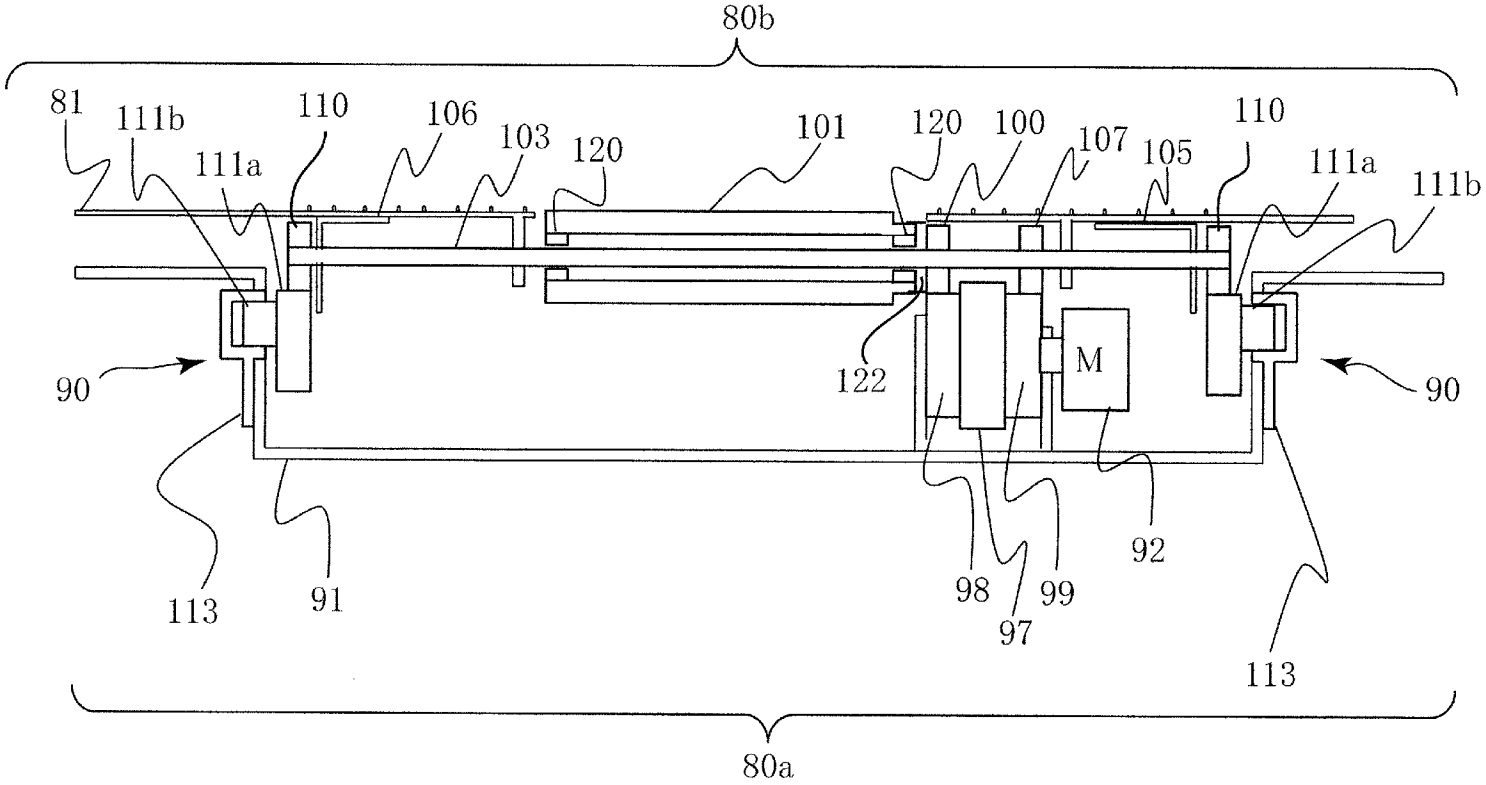
FIG. 11 is a schematic cross-sectional view illustrating a transmission configuration of a pre-fixing conveyance apparatus according to the first embodiment.

That is, in a state where the motor 92 is rotated in direction A of FIG. 9, the driving force is input to the elevating input gear 107 via the elevating one way gear 99, and the drive pulley shaft 103 is driven to rotate, as illustrated in FIG. 11. The drive pulley shaft 103 transmits the driving force from the motor to the elevating mechanism 90, and when the drive pulley shaft 103 is driven to rotate, the cam gears 111 are rotated and the position of the elevating portion 80*b* is elevated. On the other hand, in a state where the motor 92 rotates in direction B of FIG. 9, drive is transmitted from the conveyance one way gear 98 to the conveyance input gear 100, and the drive is further transmitted from the conveyance input gear 100 to the drive pulley 101, rotating the conveyor belt 82. The detailed configuration of the drive pulley 101 and the conveyance input gear 100 will be described later.

Warping Preventing Configuration of Guide Member

Now, a warping preventing configuration of the sheet support portions 84*a* and 84*b* of the guide member 81 will be described. In the present embodiment, the above-described guide member 81 is formed of PBT (polybutylene terephthalate). Since PBT has similar charging characteristics as toner, the pre-fixed toner can be prevented from moving by the influence of frictional electrification caused by the sliding of the sheet against the guide member 81 and causing image defects.

Figure 14:
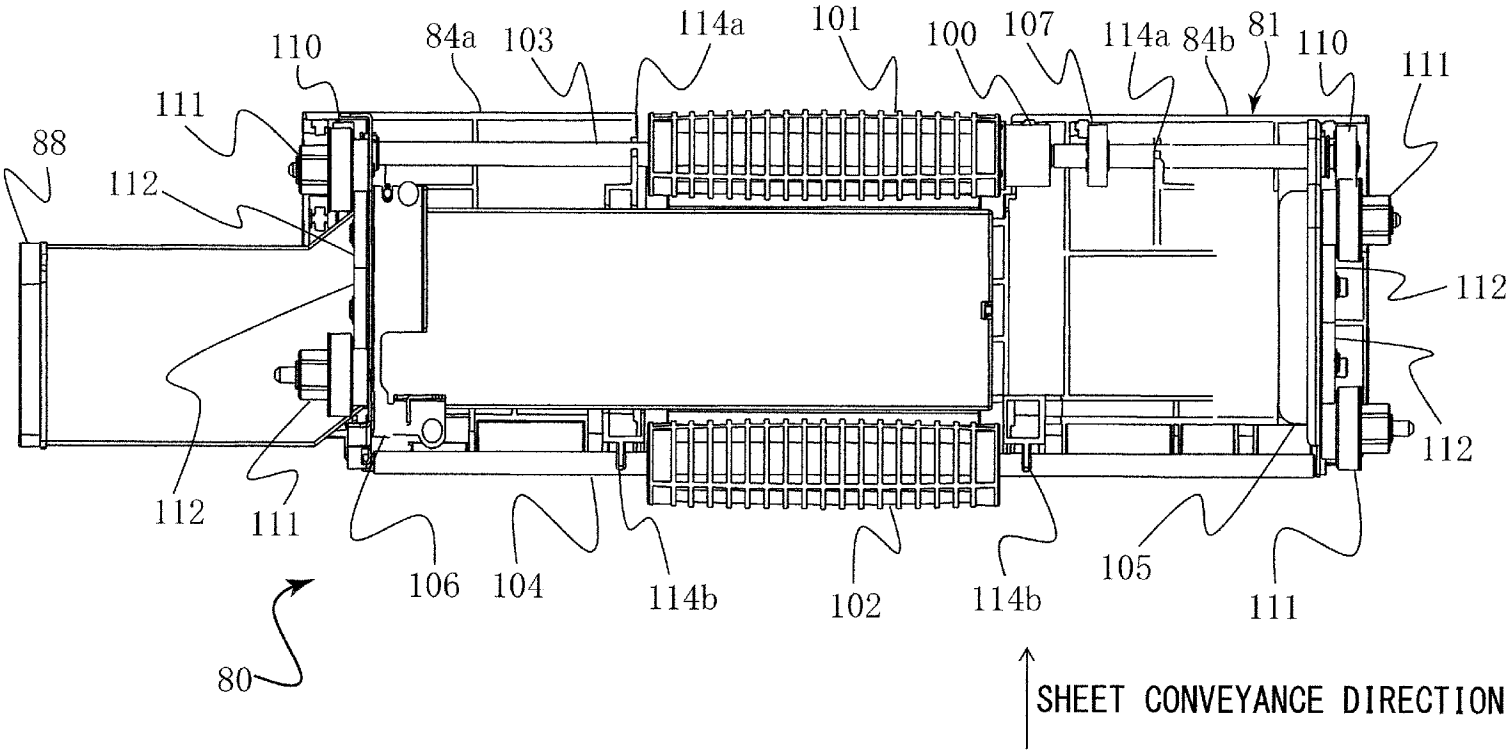
FIG. 14 is a bottom view of an elevating portion according to the first embodiment.

On the other hand, PBT is an easily warped material, so the shape of the guide member 81 is warped and deformed by post-mold contraction. In a state where a flatness of the sheet support portions 84*a* and 84*b* of the guide member 81 is deteriorated by the warping, the position of the sheet may be displaced and the sheet may be wrinkled during fixing operation. Therefore, according to the present embodiment, the sheet support portions 84*a* and 84*b* of the guide member 81 are respectively mounted at multiple positions to the drive pulley shaft 103 and the driven pulley shaft 104, as illustrated in FIG. 14.

Figure 10:
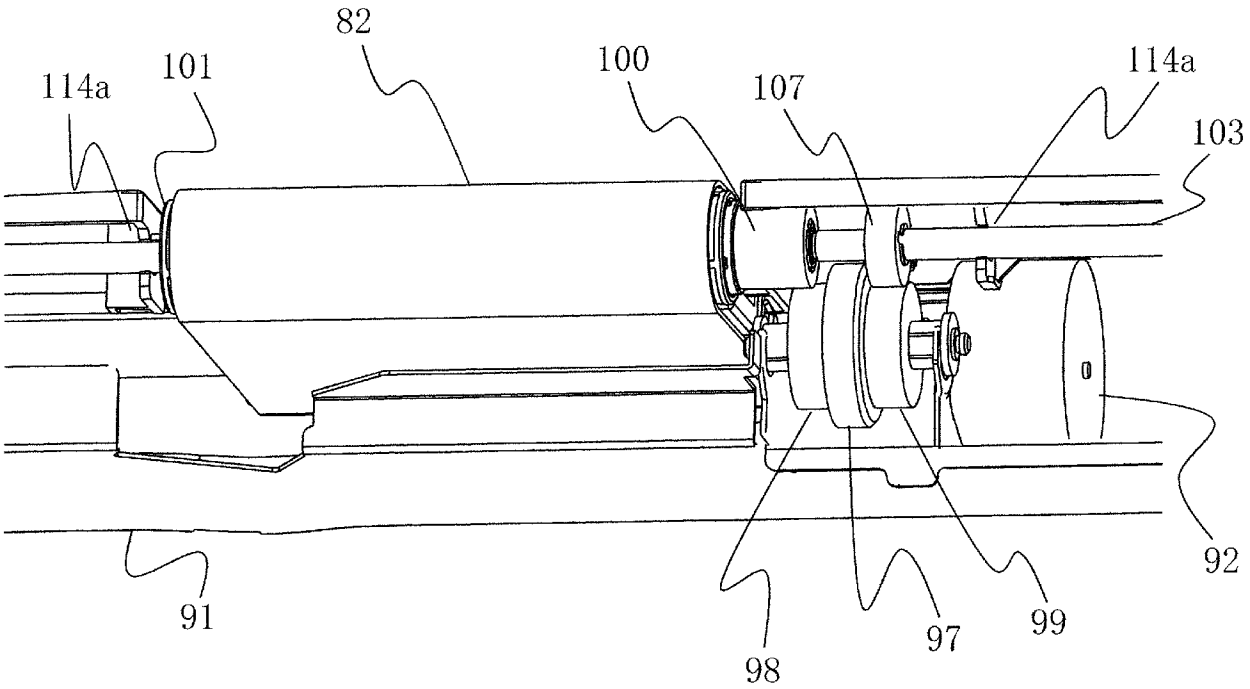
FIG. 10 is a perspective view illustrating a configuration around a drive train according to the first embodiment.

Specifically, the sheet support portions of the guide member 81 are mounted to the drive pulley shaft 103 and the driven pulley shaft 104 via the front side panel 105 and the rear side panel 106 supporting a first end and a second end of the drive pulley shaft 103 and the driven pulley shaft 104. Further, the sheet support portions 84*a* and 84*b* of the guide member 81 are supported in a height direction with respect to the drive pulley shaft 103 via two positioning portions 114*a*, as illustrated in FIG. 10. Thus, the sheet support portions 84*a* and 84*b* of the guide member 81 are positioned, i.e., fixed, in the height direction with respect to the drive pulley shaft 103 at four locations, which are the front side panel 105, the rear side panel 106, and the two positioning portions 114*a*. That is, in the present embodiment, the sheet support portions 84*a* and 84*b* of the guide member 81 have four mounting portions 105, 106, 114*a* and 114*a* with respect to the drive pulley shaft 103.

Figure 13:
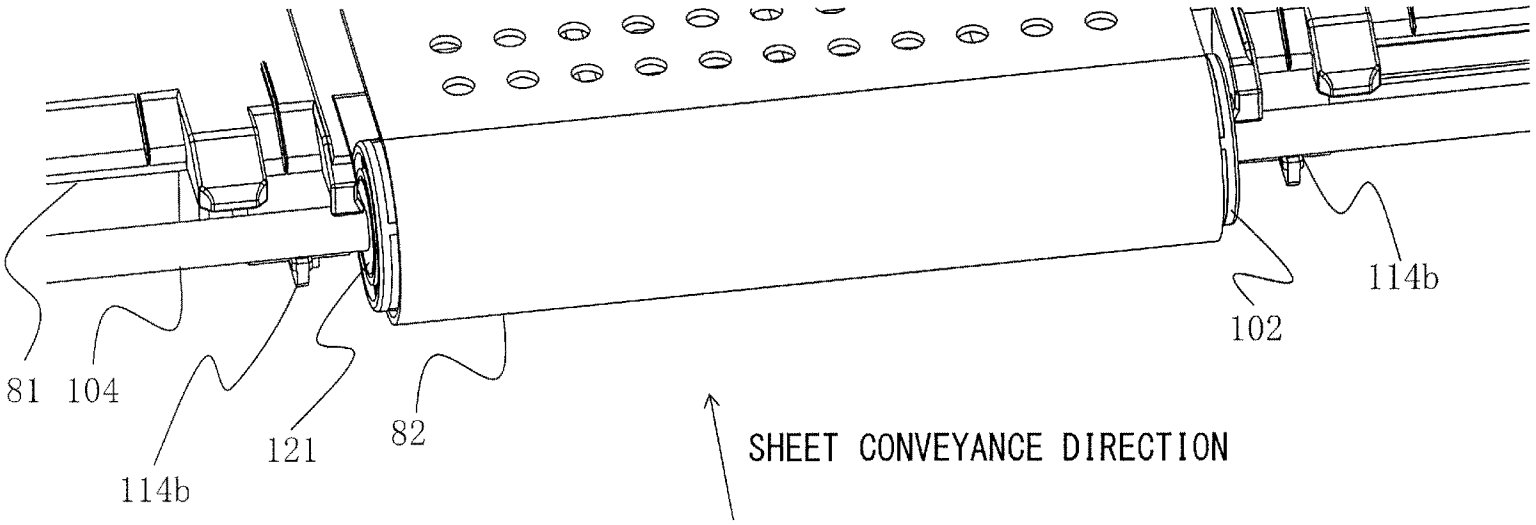
FIG. 13 is a perspective view illustrating a mounting portion where a guide member is mounted to a drive pulley shaft.

Similarly, the sheet support portions 84*a* and 84*b* of the guide member 81 are supported in a height direction with respect to the driven pulley shaft 104 via two positioning portions 114*b*, in addition to the front side panel 105 and the rear side panel 106 (refer to FIG. 13). Thus, the sheet support portions 84*a* and 84*b* of the guide member 81 are positioned, i.e., fixed, in the height direction with respect to the driven pulley shaft 104 at four locations, which are the front side panel 105, the rear side panel 106, and the two positioning portions 114*b*. That is, in the present embodiment, the sheet support portions 84*a* and 84*b* of the guide member 81 have four mounting portions 105, 106, 114*b* and 114*b* with respect to the driven pulley shaft 104. It is preferable to provide a plurality of mounting portions with respect to the drive pulley shaft 103 and the driven pulley shaft 104, and the warping of the sheet support portions 84*a* and 84*b* can be regulated effectively if three or more mounting portions are provided.

Due to this arrangement, in a state where the guide member 81 is warped and deformed, forces acting to deform the other member are mutually applied between the guide member 81, where significant warping occurs, and the drive pulley shaft 103 and the driven pulley shaft 104, where only slight warping occurs. Hereafter, a bending strength of the guide member 81 will be described, taking the relationship with the drive pulley shaft 103 as an example.

Figure 12A:
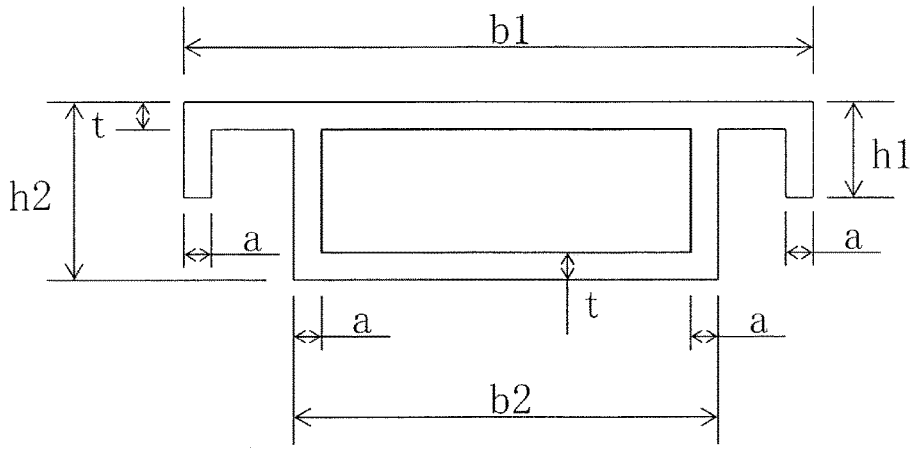
FIG. 12A is a schematic cross-sectional view of a guide member taken at cross-section XIIA-XIIA of FIG. 3.
Figure 12B:
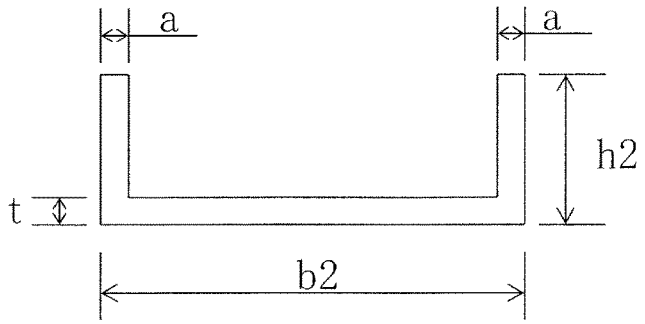
FIG. 12B is a schematic cross-sectional view of the guide member taken at XIIB-XIIB of FIG. 3.
Figure 12C:
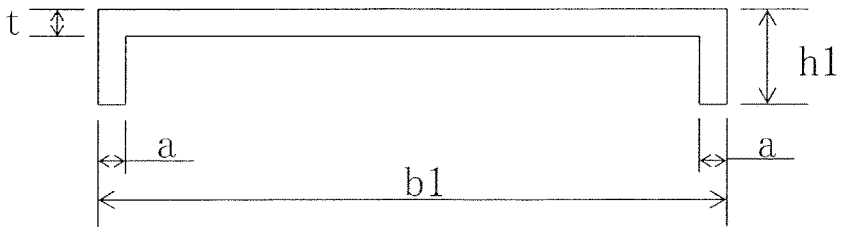
FIG. 12C is a schematic cross-sectional view of a guide member taken at XIIC-XIIC of FIG. 3.

A schematic cross-sectional view of the guide member 81 taken at XIIA-XIIA of FIG. 3 is illustrated in FIG. 12A, a schematic cross-sectional view taken at XIIB-XIIB is illustrated in FIG. 12B, and a schematic cross-sectional view taken at XIIC-XIIC is illustrated in FIG. 12C. As illustrated in FIG. 3 and FIGS. 12A through 12C, the cross section of the guide member 81 can be divided largely into three parts, wherein FIG. 12A illustrates a cross section of an area 81*e* including the sheet support portion 84*a* and the duct portion 86. FIG. 12B illustrates a cross section of an area 81*f* including the opening portion 83 of the duct portion 86, and FIG. 12C illustrates a cross section of an area 81*g* formed only of the sheet support portion 84*b*. The respective parameters are as listed below:

b1=81 mm, b2=48 mm, h1=5.5 mm, h2=15 mm, a=1.0 mm, and t=1.5 mm.

A cross-sectional secondary moment of the guide member 81 is computed, wherein the cross-sectional secondary moment of the area 81*e* of FIG. 12A is I1=9900 $mm^4$, and the cross-sectional secondary moment of the area 81*f* of FIG. 12B is I2=858 $mm^4$. Further, the cross-sectional secondary moment of the area 81*g* of FIG. 12C is I3=64 $mm^4$. In contrast, the drive pulley shaft 103 is a shaft having a diameter of Φ 6 mm, and the cross-sectional secondary moment thereof is I4=63.6 $mm^4$. Further, a bending elastic modulus E1 of the PBT constituting the guide member 81 is approximately 2.4 GPa, and the material of the drive pulley shaft 103 is a free-cutting steel with a bending elastic modulus E2 of approximately 200 GPa.

The deformation tendency is determined based on a multiplier of cross-sectional secondary moment and bending elastic modulus, and the result is as follows:

Area 81*e* of guide member 81: E1×I1=23700 $mm^4$·MPa
Area 81*f* of guide member 81: E1×I2=2060 $mm^4$·MPa
Area 81*g* of guide member 81: E1×I3=153 $mm^4$·MPa
Drive pulley shaft 103: E2×I4=12700 $mm^4$·MPa Based on the above results, it can be recognized that the area 81*e* of the guide member 81 is most resistant to bending, and that the amount of deformation of the area 81*e* is small. Further, it can be recognized that the other areas 81*f* and 81*g* are less resistant to bending than the drive pulley shaft 103, so that the areas can be deformed to be arranged along the drive pulley shaft 103. Therefore, even if the guide member 81 is deformed by contraction during molding, the warping of the whole guide member can be straightened to correspond to the shape of the drive pulley shaft 103, and the position of the sheet can be prevented from collapsing. The deformation of the guide member 81 can similarly be straightened by the driven pulley shaft 104 formed of a similar material as the drive pulley shaft 103.

Drive Pulley and Conveyance Input Gear

Next, a configuration of the conveyance input gear 100 as transmission portion transmitting the driving force from the drive pulley 101 and the driving source to the drive pulley will be described in detail. As illustrated in FIG. 11, the conveyance input gear 100 to which the power from the motor 92 is input through the conveyance one way gear 98 is supported rotatably in an independent manner with respect to the drive pulley shaft 103. In further detail, the position of the conveyance input gear 100 is determined only with respect to the axial direction of the drive pulley shaft 103, and the conveyance input gear rotates while sliding against the drive pulley shaft 103.

Further, the drive pulley 101 is similarly rotatably supported in an independent manner with respect to the drive pulley shaft 103, and the drive pulley 101 is supported via a bearing 120 on the drive pulley shaft 103. That is, the bearing 120 is configured as a bearing portion disposed between the drive pulley 101 and the drive pulley shaft 103, and supports the drive pulley 101 rotatably in an independent manner from the drive pulley shaft 103. The conveyance input gear 100 and the drive pulley 101 are disposed coaxially, and coupled via a coupling mechanism 122. Therefore, in a state where the motor is rotated in the direction of B for conveying sheets, rotation is transmitted via the conveyance one way gear to the conveyance input gear, and the drive pulley 101 is rotated via the conveyance input gear 100. In this state, the conveyance input gear 100 and the drive pulley 101 are rotated independently from the drive pulley shaft 103, and the drive pulley shaft 103 is stopped.

As described, the sheet support portions 84*a* and 84*b* of the guide member 81 are mounted to the drive pulley shaft 103 to enhance the parallel level of the sheet support surface, and deformation force of the guide member 81 is applied to the sheet support portions. If the drive pulley shaft 103 attempts to rotate, a large drive torque is required since frictional force is generated between the shaft 103 and the guide member 81, but in the present embodiment, the drive pulley shaft 103 is not rotated when the conveyor belt 82 is driven to convey sheets. That is, in a state where the conveyor belt 82 is driven to rotate constantly during conveyance of sheets, frictional load generated by straightening the deformation of the guide member 81 is not applied, and load is applied only during a state where the elevating mechanism 90 moves the conveyance position, which occurs less frequently. Thereby, the driving torque of the motor 92 during conveyance of sheets can be reduced, and the motor can be driven with low power, such that the rising of temperature of the motor 92 can be suppressed. For example, the rising of motor temperature can be reduced by approximately 10° C. compared to a state where the drive pulley shaft 103 is rotated together with the drive pulley 101. At the same time, the warping of the guide member 81 can be straightened, such that the sheet can be conveyed preferably to the fixing unit, and wrinkles can be prevented from being generated on the sheet at the fixing nip.

Since the conveyance input gear 100 is positioned at the vicinity of an end portion in the width direction of the conveyor belt, serving as a suction belt, 82, the position in which the drive of the belt is received is near the center position. According to this arrangement, a moment in the direction tilting the pulley is less likely to occur even in a state where the driving force is received, and the alignment of the pulleys is maintained, such that deviation of the belt is prevented.

As described, the guide member is attached to the rotary drive member shaft 103, and the rotary drive member and the transmission portion are independently and rotatably attached to the rotary drive member shaft 103. Therefore, the positional relationship between the belt member 82 and the guide member 81 can be maintained preferably. Since there is no need to rotate the rotary drive member shaft 103 in a state where the rotary drive member 101 is rotated to convey sheets, the sheets can be conveyed with a small drive load.

Second Embodiment

Figure 15:
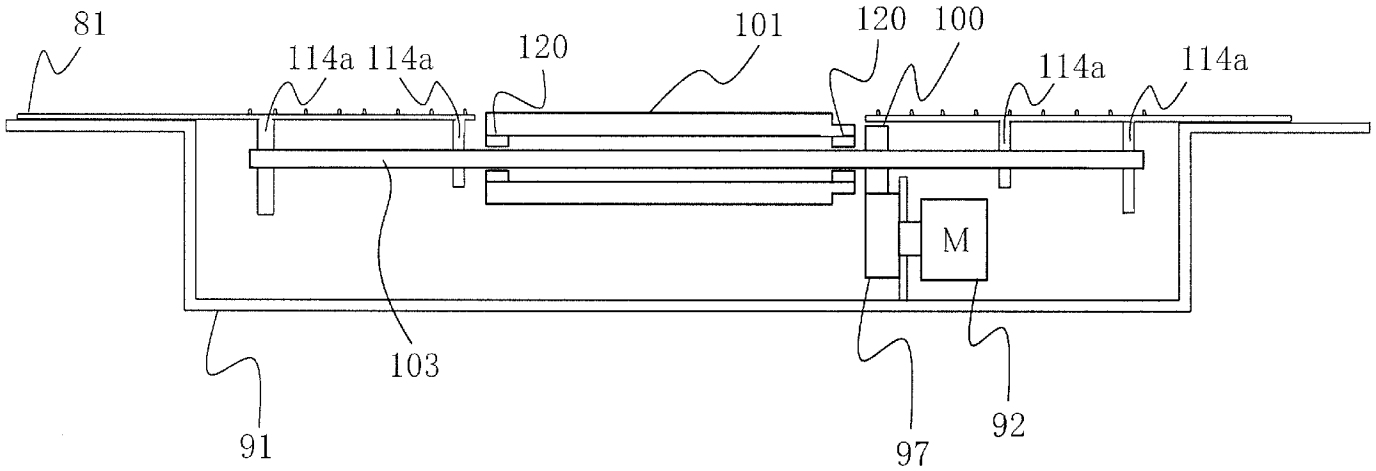
FIG. 15 is a schematic cross-sectional view of a pre-fixing conveyance apparatus according to a second embodiment.

Now, a pre-fixing conveyance apparatus 80A serving as a sheet conveyance apparatus according to a second embodiment will be described with reference to FIG. 15. The second embodiment differs from the first embodiment in that the pre-fixing conveyance apparatus 80A is not elevated, and that the guide member 81 is fixed directly to the frame 91. That is, the first embodiment adopts a configuration in which the position of the elevating portion 80*b* can be elevated and lowered, but in a product where a sheet having a high stiffness is out of range of specification, there is no need to elevate the position of the elevating portion 80*b*. Therefore, the guide member 81 can be fixed directly to the frame 91.

According further to the first embodiment, both end portions of the drive pulley shaft 103 were supported by the front side panel 105 and the rear side panel 106, by providing the front side panel 105 and the rear side panel 106 on the guide member 81. However, as illustrated in FIG. 15, both end portions of the drive pulley shaft 103 can be supported by the guide member 81, without providing the front side panel 105 and the rear side panel 106. Then, the positioning portions 114*a* and 114*b* of the guide member 81 and the drive pulley shaft 103 can be disposed at a plurality of positions, and the warping of the guide member 81 can be deformed along the drive pulley shaft 103.

In the embodiment described above, the conveyance input gear 100 and the drive pulley 101 are disposed separately, but they can also be formed integrally, and a bearing can be disposed between the conveyance input gear 100 and the drive pulley shaft 103. Moreover, rotation between the conveyance input gear 100 and the drive pulley 101 can be transmitted not only via a coupling mechanism but also via other mechanisms.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-068676, filed Mar. 30, 2016, which is hereby incorporated by reference herein in its entirety.

What is claimed is:

1. A sheet conveyance apparatus comprising:

a rotary drive member configured to rotate by receiving transmission of driving force from a driving source;

a driven rotary member arranged with a predetermined distance in a sheet conveyance direction from the rotary drive member;

an endless belt member supported on the rotary drive member and the driven rotary member, and configured to be rotated by a rotation of the rotary drive member;

a guide member configured to guide a sheet conveyed by the belt member; and a shaft configured to support the rotary drive member, the guide member being mounted to the shaft, wherein the rotary drive member is supported on the shaft in a rotatable manner with respect to the shaft.

2. The sheet conveyance apparatus according to claim 1, wherein the guide member comprises three or more mounting portions with respect to the shaft.

3. The sheet conveyance apparatus according to claim 1, wherein the guide member comprises a first portion configured to engage with the shaft, a second portion arranged at a position different from the first portion in a width direction of a sheet intersecting the sheet conveyance direction, and configured to engage with the shaft, and a third portion arranged at a position different from the first and second portions in the width direction, and configured to engage with the shaft.

4. The sheet conveyance apparatus according to claim 1, further comprising an elevating mechanism configured to elevate the belt member and the guide member, wherein the shaft is configured to transmit a driving force from the driving source to the elevating mechanism.

5. The sheet conveyance apparatus according to claim 4, further comprising:

a transmission portion supported on the shaft and configured to transmit a driving force from the driving source to the rotary drive member, the transmission portion being supported on the shaft rotatably with respect to the shaft;

an elevation transmission portion configured to rotate integrally with respect to the shaft;

a first engagement portion configured to engage with the elevation transmission portion, the first engagement portion driven to rotate in a state where the driving source is driven to rotate in a first direction, and rotating the shaft via the elevation transmission portion;

a second engagement portion configured to engage with the transmission portion, the second engagement portion driven to rotate in a state where the driving source is driven to rotate in a second direction opposite to the first direction, and rotating the rotary drive member via the transmission portion; and a bearing portion provided between the rotary drive member and the shaft, the bearing portion configured to support the rotary drive member rotatably in an independent manner from the shaft.

6. The sheet conveyance apparatus according to claim 1, further comprising a transmission portion supported on the shaft and configured to transmit a driving force from the driving source to the rotary drive member, the transmission portion being supported on the shaft rotatably with respect to the shaft, wherein the belt member is a suction belt having a plurality of holes formed thereto, the guide member comprises a duct portion opening at an inner side of the suction belt and sucking in air, and a sheet support portion configured to support a sheet and provided on both sides of the suction belt in a width direction orthogonal to the sheet conveyance direction, and the transmission portion is positioned at a vicinity of an end portion in the width direction of the suction belt.

7. The sheet conveyance apparatus according to claim 1, further comprising a driven rotary member shaft configured to support the driven rotary member such that the driven rotary member is rotated independently from the driven rotary member shaft, wherein the guide member comprises three or more mounting portions with respect to the driven rotary member shaft.

8. The sheet conveyance apparatus according to claim 1, wherein the guide member is formed of polybutylene terephthalate.

9. The sheet conveyance apparatus according to claim 1, wherein the guide member comprises a first support portion configured to support a conveyed sheet, and a second support portion configured to support the conveyed sheet, and the belt member is arranged between the first support portion and the second support portion in a width direction of the sheet intersecting the sheet conveyance direction.

10. The sheet conveyance apparatus according to claim 1, further comprising a transmission portion supported on the shaft and configured to transmit a driving force from the driving source to the rotary drive member, wherein the transmission portion is supported on the shaft rotatably with respect to the shaft.

11. The sheet conveyance apparatus according to claim 1, wherein the shaft does not rotate in a state where a driving force from the driving source is transmitted to the rotary drive member to rotate the belt member, and the rotary drive member is rotating.

12. An image forming apparatus comprising:

a sheet feeding unit configured to feed a sheet; and the sheet conveyance apparatus according to claim 1 configured to convey the sheet fed by the sheet feeding unit.

13. The image forming apparatus according to claim 12, further comprising:

an image forming unit configured to form an image on the sheet fed by the sheet feeding unit; and a fixing portion configured to apply pressure and heat to the sheet on which an image has been formed by the image forming unit to fix the image, wherein the sheet conveyance apparatus is arranged downstream of the image forming unit and upstream of the fixing portion in the sheet conveyance direction, and conveying the sheet on which a non-fixed image is formed to the fixing portion.

* * * * *